US007077184B2

(12) United States Patent
Mertins, Jr. et al.

(10) Patent No.: US 7,077,184 B2
(45) Date of Patent: Jul. 18, 2006

(54) SYSTEM, APPARATUS, AND METHOD FOR DISPENSING STRIPS OF TAPE

(76) Inventors: Orville Lee Mertins, Jr., 30 Ferguson Rd., Whitesboro, TX (US) 76273; Archie Wes Sutton, 2851 Harrell Rd., Howe, TX (US) 75459

( * ) Notice: Subject to any disclaimer, the term of this patent is extended or adjusted under 35 U.S.C. 154(b) by 0 days.

(21) Appl. No.: 10/752,903

(22) Filed: Jan. 5, 2004

(65) Prior Publication Data

US 2005/0145344 A1 Jul. 7, 2005

(51) Int. Cl.
*B32B 37/00* (2006.01)

(52) U.S. Cl. ..... 156/510; 156/577; 242/575.3; 242/588.1

(58) Field of Classification Search ..... 156/510, 156/574, 577, 579, 523, 527; 242/575, 575.3, 242/588.1, 597.8; 224/162
See application file for complete search history.

(56) References Cited

U.S. PATENT DOCUMENTS 2,196,489 A * 4/1940 Bennett ..... 242/575.3
2,470,250 A 5/1949 Kienle
2,963,208 A 12/1960 Yates et al.
3,140,805 A 7/1964 Seror
3,217,955 A 11/1965 Tinkey
3,502,252 A 3/1970 Mariani
3,811,632 A * 5/1974 Bassett ..... 242/571.6
4,160,530 A * 7/1979 Plach ..... 242/575.3
4,334,652 A * 6/1982 Blackburn ..... 242/575.3
4,964,586 A * 10/1990 Lerch ..... 242/575.3
5,482,182 A 1/1996 Thompson et al.
5,490,640 A * 2/1996 Miller et al. ..... 242/571.6
5,641,109 A 6/1997 Willoughby
5,802,695 A 9/1998 Willoughby
6,085,955 A 7/2000 Hicks et al.
6,367,733 B1 * 4/2002 McLaughlin ..... 242/575.3
6,651,718 B1 11/2003 Hua

* cited by examiner

*Primary Examiner*—James Sells
(74) *Attorney, Agent, or Firm*—Schultz & Associates, P.C.

(57) ABSTRACT

The invention provides a tape dispenser system, apparatus, and method for dispensing strips of tape used for masking or tacking. The tape dispenser includes a frame, attachment/securement means, a quick release locking expandable tape hub expansion member mechanism for removably securing a tape roll to the expandable tape hub, and a user preference adaptable tape cutter assemblage for easily accommodating left-handed and right-handed users. The cutter assembly of the invention includes at least one heavy duty blade for increased ease of cutting a plurality of types of tapes.

5 Claims, 5 Drawing Sheets

SYSTEM, APPARATUS, AND METHOD FOR DISPENSING STRIPS OF TAPE

FIELD OF THE INVENTION

This invention relates to a system, apparatus, and method that permit a user to dispense various types of tape strips quickly and efficiently. In particular, the invention relates to a system, apparatus, and method that permit the user to easily and quickly removably secure tape rolls in a plurality of widths to the apparatus using a quick release hub expansion mechanism. More particularly, the invention relates to a system, apparatus, and method that allow easy conversion of the apparatus to easily accommodate left-handed and right-handed preference users thereby permitting increased ease of dispensing for all users.

BACKGROUND OF THE INVENTION

Most people often believe they know everything they need to know about the task of painting, an assumption that often can lead to poor quality work. This specifically applies to the general preparation of areas that are to be painted as much as it does to the actual application of the paint. Therefore, proper preparation of surface areas is easily assessed as the key to overall success in the painting environment. Few people realize this, or even like to admit it, since it leads to increased work. One must be sure that he or she understands and uses the proper equipment for preparation and painting in addition to adhering to proper application procedures to ensure an overall quality paint job.

In the preparation phase, the proper application of masking tape, tacking or the like, is often vital to achieving a desirable and professional looking painted surface. It is a step that is all too often left out, and the final job can reflect its omission. It is easy to start painting and not go through the certain preparation steps. Indeed, for a while the paint job may look satisfactory, but sooner or later the poor quality will appear. Masking off woodwork, trim, doors, windows, and other surfaces with newspaper and masking tape can often provide the results desired. Often, the ease of application of the masking tape, or the like, is inhibited by the tape dispenser mechanism itself. Many dispensers are cumbersome and require the use of two hands to load the tape roll and to actually dispense the tape from the dispenser.

Today, tape dispensers are generally known in the art and can range from very complex devices to those of extreme simplicity. Many tape dispensers provide enhanced convenience and ease of use by simply allowing the dispenser to be located within easy reach of the user and/or work space. In addition, simplicity of dispensers has also provided the convenience of attaching the apparatus to the user's belt enabling a user to dispense tape from their waist area. However, consideration of whether the user was left or right handed and was not considered or even determined to be a factor and was therefore not remedied. Furthermore, many tape dispensers provide various forms of cutting blades used to sever the strip of tape once dispensed to the desired length.

However, in view of the foregoing it would be advancement in the art to provide a tape dispenser system, apparatus, and method wherein a tape roll is easily, quickly, and removably secured onto a expandable tape hub using only one hand wherein the expandable tape hub has a quick release hub expansion mechanism built into the hub. In addition, it would be an advancement to provide the dispenser as described but with the further ability to accommodate left and/or right-handed users. In addition, it would be an advancement to provide a dispenser that provides a way to apply radial pressure to the tape roll while cutting to prevent turning of the tape roll. Such a system, apparatus, and method is disclosed and claimed herein.

SUMMARY OF INVENTION

The invention disclosed herein provides a system, apparatus, and method for dispensing tape, wherein the tape dispenser apparatus can be removably worn by the user or removably attached to an object for rigid support. The dispenser comprises a frame, an extension post, at least one frame attachment means, a tape roll hub, a quick-release expandable tape hub mechanism for removably securing the tape roll to the expandable tape hub, and a user preference adaptable tape cutter assemblage mechanism for quickly and easily accommodating left-handed and right-handed users, wherein the cutter assemblage includes a tape cutting blade. The tape dispenser of the present invention permits the user to dispense tape in either a left or right-handed orientation without having to remove hands and/or eyes from what they are working on, thus increasing safety. It is, therefore, a primary object of the present invention to provide improvements in tape dispenser assemblies and methods of use in general.

A further object of the present invention is to provide improvements in the system, apparatus and methods for removably securing a tape roll onto a expandable tape hub. Such improvements provide ease of securement of tape rolls and permit quick and easy tape roll removal using only one hand while concurrently accommodating left-handed and right-handed users.

Other systems, methods, features, and advantages of the present invention will be or become apparent to one with skill in the art upon examination of the drawings and detailed description. It is intended that all such additional systems, methods, features, and advantages be included within this description, be within the scope of the present invention, and be protected by the accompanying claims.

BRIEF DESCRIPTION OF THE DRAWINGS

A better understanding of the invention can be obtained from the following detailed description of one exemplary embodiment when considered in conjunction with the following drawings in which:

FIG. 4A-1 is a side elevation view depicting the expandable tape hub and the expansion hub retaining ring.

FIG. 4A-2 is a front elevation view of the expansion hub retaining ring in FIG. 4A-1 of the tape dispenser of FIG. 1 in accordance with the invention.

DETAILED DESCRIPTION OF THE PREFERRED EMBODIMENT

Figure 1:
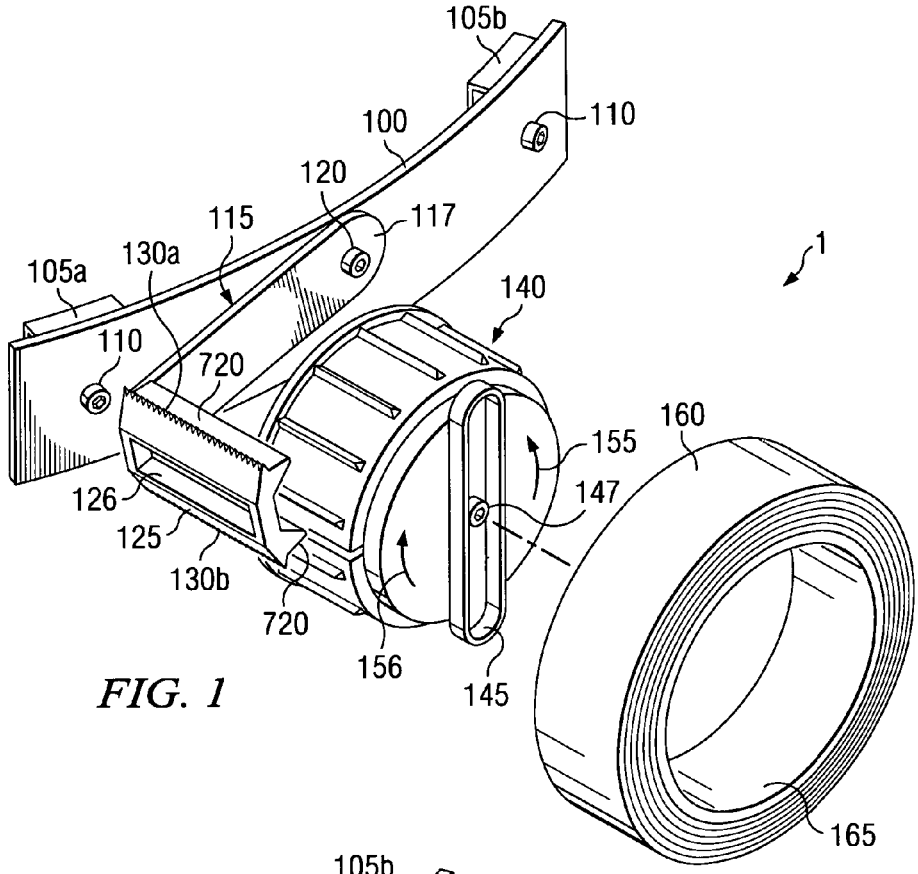
FIG. 1 is a perspective view depicting the tape dispenser in accordance with the invention.
Figure 2:
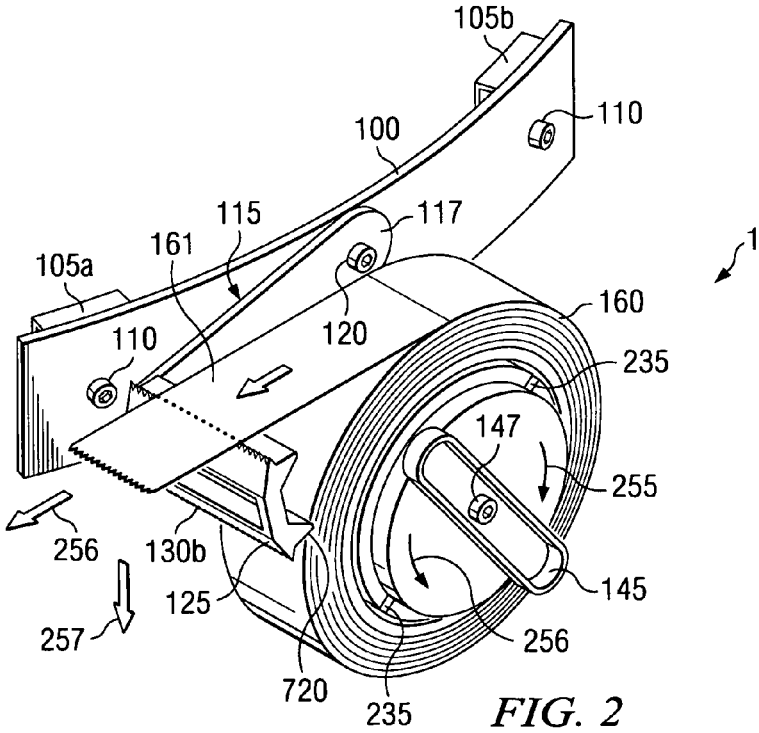
FIG. 2 is a perspective view depicting the tape dispenser with a tape roll installed onto the expandable tape hub device in accordance with the invention.

Referring now to FIGS. 1 and 2, a perspective view of the tape dispenser system and apparatus according to a preferred embodiment is shown generally at 1 in relation to a tape roll 160 workpiece being un-installed (FIG. 1) and installed (FIG. 2). The tape dispenser 1 of the present invention is constructed from high impact durable material, such as resilient plastic or the like, metal, or other similar durable materials, having an innovative unique design. The tape dispenser 1 is shown in FIG. 1 configured having an arcuate frame 100 but can be constructed in a plurality of shapes such as a generally straight frame 100 without detracting from the spirit of the invention. The arcuate frame 100, as shown in FIG. 1, permits the dispenser 1 to be comfortably worn about the waist of the person using the tape dispenser 1. If the tape dispenser is configured with a generally straight frame 100 it can easily be attached to an object also having a generally straight edge or flat surface.

The tape dispenser 1 of the preferred embodiment can be releasably attached or clipped to the belt (not shown) or clothing of a user by utilizing clips 105*a* and 105*b* provided and mounted near each end of the frame 100 structure. The clips 105*a*, 105*b* are attached to the frame 100 by use of threaded fasteners 110. In an alternate embodiment the frame 100 can be alternatively constructed without clips 105*a*, 105*b*. In this alternate embodiment, the frame 100 is manufactured having at least one vertical or horizontal slot (both not shown) near each end of the frame to permit the user to interweave a belt (not shown), or similar object through the slots for removably and securely retaining the tape dispenser 1 to an object or about the waist of the user.

In further reference to FIG. 1 and FIG. 2 a cutter assemblage mechanism 115 is provided on the tape dispenser 1 and is pivotally mounted via a mounting hole (not shown) in cutter assemblage arm 117 to the tape dispenser 1 frame 100 using fasteners 120. The mounting hole (not shown) in the cutter assemblage arm 117 is located near a proximal end of arm 117 and opposite a distal end of arm 117 containing blade assembly 125. The pivotable mounting allows for the cutter assemblage mechanism 115 to be moved from one side of the tape roll to the other thereby effectively accommodating both left-handed and right-handed users. The cutter assemblage mechanism further comprises a blade assembly 125, and a tape tensioning slot 126, at least two cutting surface blades 130*a*, 130*b* wherein at least one cutting surface has a plurality of cutting teeth disposed thereon, at least two multi-purpose non-cutting tape retaining/bearing surfaces 720 disposed in an adjacent contiguous parallel relationship to each cutting surface blades. When used as a retaining surface, the tape retaining/bearing surface 720 provides a non-cutting and generally flat surface to hold the edge of the tape 161 off of the tape roll 160 between uses. When used as a bearing surface, retaining/bearing surface 720 provides a non-cutting and generally flat surface that permits a weight-bearing force to be applied against the tape preventing the tape roll and hub 140 from rotating and preventing cutting of the tape on the tape roll 160 by the non-cutting blade.

Tape tensioning slot 126 includes a horizontal slot for accommodating removal of the tape for the blade and for tensioning which can be applied to the tape while pulling back towards the tape roll for the cutting of the tape by the upper facing blade (130*a* or 130*b*), depending upon configuration of the cutter mechanism. Such tensioning forces permit tapes to be more easily cut by blade 130*a* or 130*b*.

Figure 7:
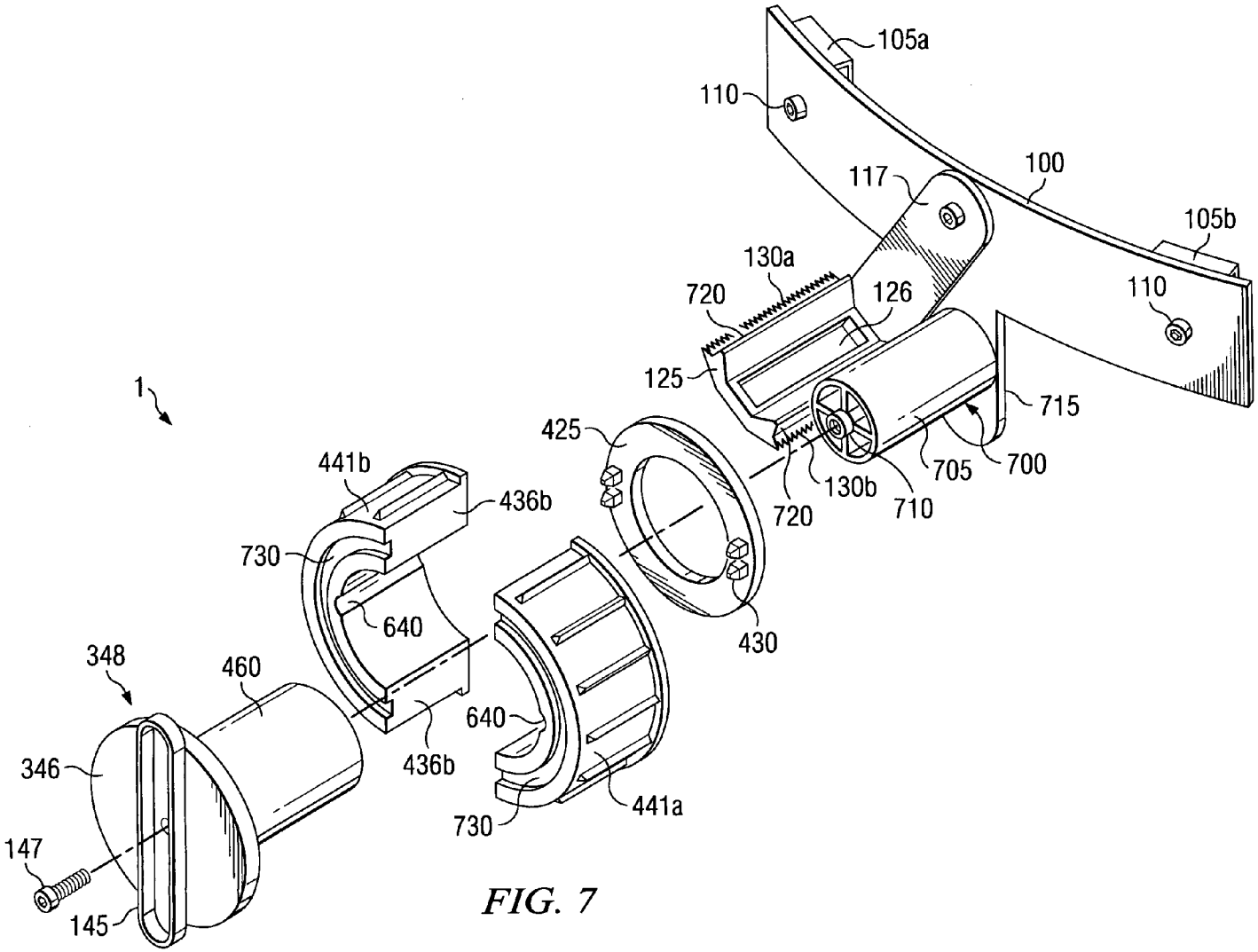
FIG. 7 is a perspective exploded view of the various parts of the present invention.

Referring to FIG. 7, the frame extension post 715 is disposed in a generally downward orientation extending from the base of frame 100 and having an axle member 700 attached thereto and extending out generally perpendicularly, with respect to the frame, from the extension post 715 to support expandable tape hub device 140. The axle member includes axle shaft 705 and primary axle nodule 710, wherein the axle nodule 710 protrudes outwardly approximately from the center end of axle 705. Axle nodule 710 acts as the pivotal mounting point for the expandable tape hub device 140 to the axle member 700 and as the predominant weight bearing point for the tape hub device 140. In the preferred embodiment, the extension post 715, having the axle member attached thereto, extends downward at about a 90 degree angle relative to the frame 100.

Figures 1, 4A:
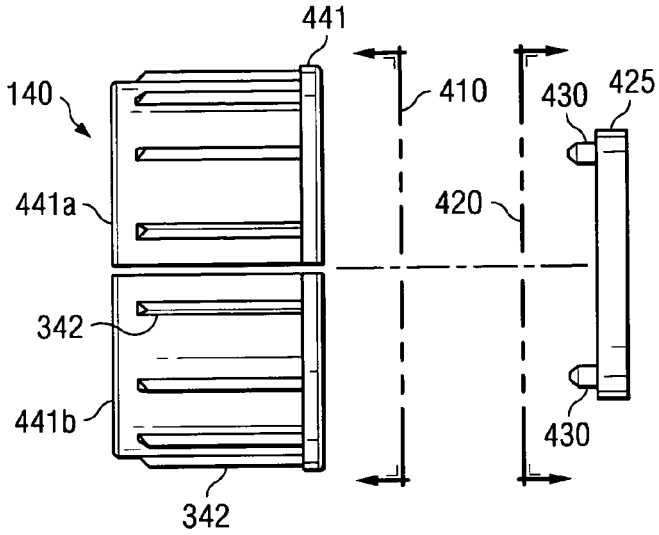
Figures 2, 4A:
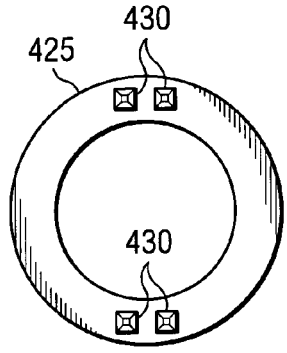
Figure 4B:
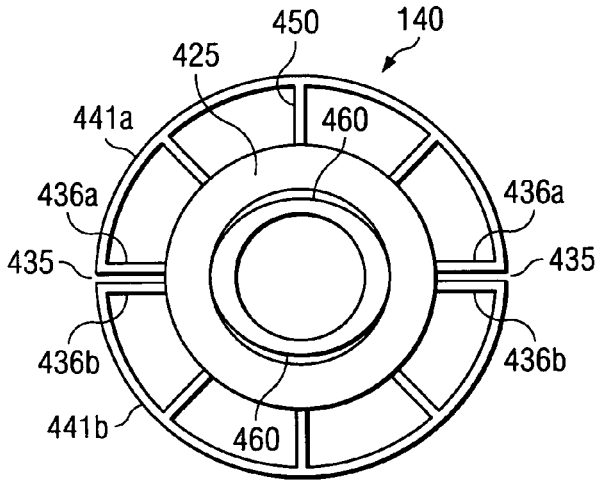
FIG. 4B is rear elevation view depicting the expandable tape hub with the expansion hub retaining ring and hub expansion member in relative positional agreement in accordance with the invention.

Referring now to FIGS. 4A and 4B a side elevation of the present invention is shown depicting the expandable tape hub device 140 having a first hub half 441*a* and a second hub half 441*b* in relation to positional retaining ring 425. The expandable tape hub device 140 of FIG. 4A further depicts the plurality of raised ribs 342 protruding outwardly about the outer diameter of the expandable tape hub device 140 for assisting in effective engagement of the inner diameter 165 of a tape roll 160. Expandable tape hub device 140 comprises a retaining ring 425 for maintaining relational position of the first hub half 441*a* as to the second hub half 441*b*. Retaining ring 425 removably attaches to the expandable tape hub device 140 via a plurality of gripping tips 430, as viewed along axis 420, located on the retaining ring 425 wherein the gripping tips 430 exert frictional gripping attachment to the expandable tape hub device 140 along two diametrically opposed inner partition walls 450 located on the inner side surface of hub halves 441*a* and 441*b* of the expandable tape hub 140.

Referring now to FIG. 4B, the inner side surface 441 viewed along axis 410 of the expandable tape hub device 140 is shown with retaining ring 425 removably attached in position on the plurality of inner partition walls 450 located on both halves 441*a*, 441*b* of the expandable tape hub 140. Further reference to FIG. 4B shows the inserted end of cam expansion member elliptical stubshaft 460 having an expansion ellipse in place and in positional agreement with the hub device 140. The position of the cam expansion elliptical stubshaft 460 as shown in FIG. 4B depicts hub halves 441*a*, 441*b* being transversely positioned by the expansion ellipse of the stubshaft 460 to bring adjacent straight walled partitions 436*a*, 436*b* of hub halves 441*a*, 441*b* into a collapsed contact relation 435. This positioning effectively causes the outer diameter of hub device 140 to decrease by approximately ¼ inch to allow for easy mounting of a tape roll 160.

Figure 5:
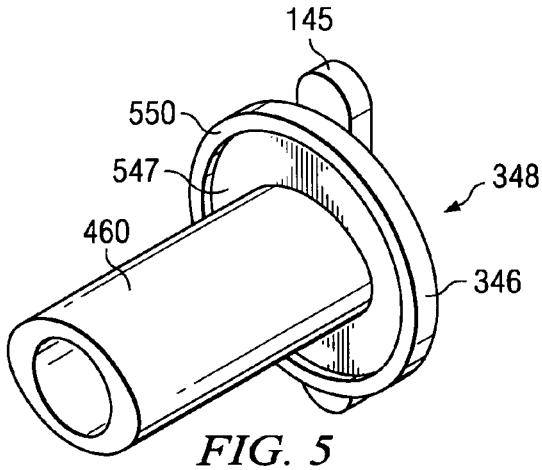
FIG. 5 is a perspective view depicting the rear side of the cam hub expansion member in accordance with the invention.

FIG. 5 depicts a perspective view of the rear side of the cam hub expansion member 348 in accordance with the preferred embodiment. The hub device 140 is advantageously and transversely collapsed and expanded in diameter utilizing the cam hub expansion member 348. The cam hub expansion member 348 comprises an expansion member face plate 346 whereon the cam expansion member finger grip 145 is integrally disposed. The cam hub expansion member 348 further comprises a cam expansion member elliptical stubshaft 460 having a generally elliptical cross-section allowing transverse collapse and causing transverse expansion of halves 441*a*, 441*b* of hub device 140. The cam expansion member elliptical stubshaft 460 is integrally formed to the back side 547 of the cam expansion member faceplate 346. The integration of the stubshaft 460 to the backside 547 of the faceplate 346 of the cam expansion member 348 allows for rotation of the stubshaft 460 utilizing the cam expansion member finger grip 145.

The cam hub expansion member 348 further comprises a circumferential raised ring 550 integrally formed to the backside 547 of the faceplate 346. The circumferential raised ring 550 fits in positional agreement into a circumferential channel 730 (shown in FIG. 7) allowing movement in unison of hub halves 441*a* and 441*b* and prevents opposing lateral displacement of hub halves 441*a* and 441*b* when the cam expansion member 348 is rotated.

Advantageously, the foregoing sequences is not only accomplished using one hand, but the forces imposed on the tape dispenser 1 are such that they do not dislodge the tape dispenser 1 from its desired mounted or attached position. In addition, the foregoing sequences are accomplished the same by both left-handed as well as right-handed persons simply by adapting the tape dispenser 1 cutter assemblage 117 to the desired position.

Figure 6A:
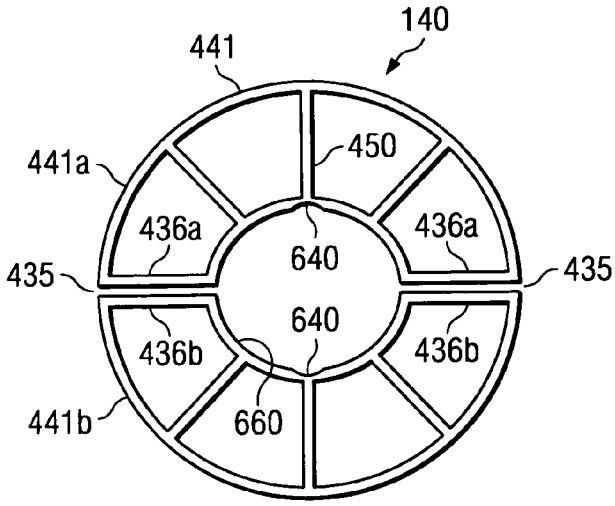
FIG. 6A is an elevation view depicting the inner side of the expandable tape hub with elliptical aperture in accordance with the invention.
Figure 6B:
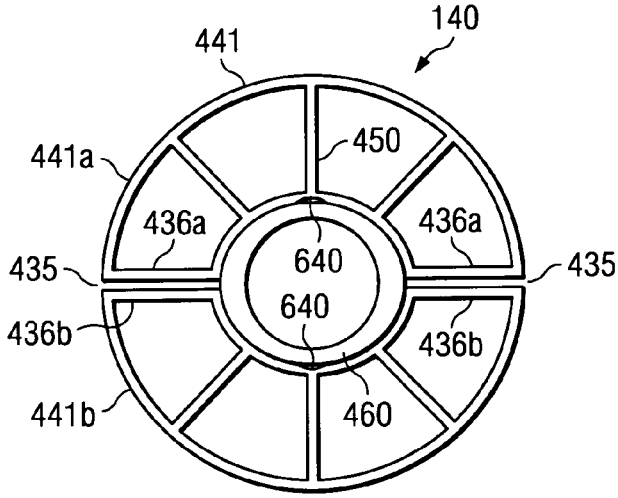
FIG. 6B is an elevation view depicting the inner side of the expandable tape hub with elliptical aperture and cam hub expansion member rotated so as to collapse the expandable tape hub in accordance with the invention.
Figure 6C:
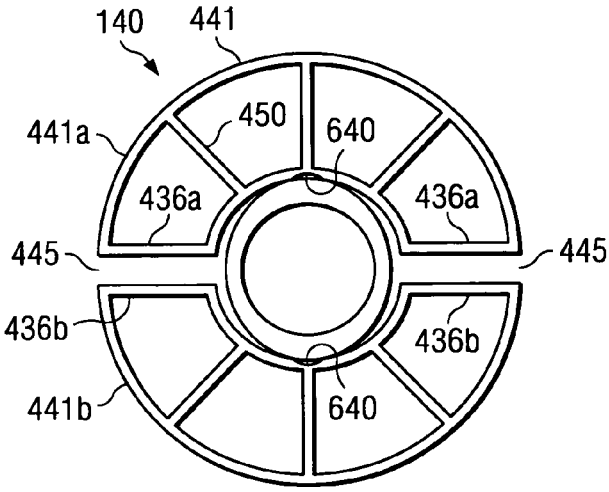
FIG. 6C is an elevation view depicting the inner side of the expandable tape hub with elliptical aperture and cam hub expansion member rotated 90 degrees to expand the expandable tape hub in accordance with the invention.

Referring now to FIGS. 6A–6C, the inner side surface 441 of the expandable tape hub device 140 is depicted in relation t hub expansion member 348. FIG. 6A shows the hub halves 441*a* and 441*b*, a plurality of inner partition walls, adjacent straight walled partitions 436*a*, 436*b*, a self-locking indentation 640, and the elliptical aperture 660 created for containing an inserted expansion member elliptical stubshaft 460. In FIG. 6A the expansion member 348 is not inserted. The elliptical aperture of the expandable hub device 140 is formed when the two halves 441*a*, 441*b* are in proximal relation to each other.

FIG. 6B shows the expandable tape hub device 140 as in FIG. 6A but having the expansion member 348 inserted positionally so as to cause halves 441*a*, 441*b* to rest in a proximate relation to each other.

FIG. 6C shows the expandable tape hub device 140 with the expansion member elliptical stubshaft 460 inserted as in FIG. 6B but further depicting the expansion member elliptical stubshaft 460 after having been rotated approximately 90 degrees. The resulting transversely displaced relation 235 of halves 441*a*, 441*b* along adjacent straight walled partitions 436*a*, 436*b* now provides for frictional securement of a tape roll 160 onto the expandable tape hub device 140. Self-locking indentation 640 provides a resting indent for the elliptical shape of stubshaft 460 when expansion member 348 is rotated, as described above, to expand tape hub 140. This provides a self-locking action to the hub 140 until rotated from resting in the indentation 640. The plurality of raised ribs 342 (shown in FIG. 3) along the outer diameter of the expandable hub assists in effective engagement of a tape roll 160 after the hub 140 has been expanded by rotation of the expansion member 348.

To load and secure a tape roll 160 onto the tape dispenser's 1 expandable tape hub device 140, the cam expansion member finger grip 145 of cam expansion member 348 is rotated approximately 90 degrees in either a counterclockwise 155 or clockwise 156 direction. By rotating the cam expansion member 348, the first hub half 441*a* and second hub half 441*b* of hub device 140 are moved radially inward along the adjacent straight walled partitions 436*a* and 436*b*. When installing a tape roll 160, the rotation of the cam expansion member finger grip 145 will effectively cause the outer diameter of the expandable tape hub device 140 to transversely decrease thus allowing easy mounting of a tape roll 160 having an inner aperture 165 onto the expandable tape hub device 140. The tape dispenser 1 of the present invention is capable of accommodating the installation of tape rolls in a plurality of widths up to and including 2 inches wide.

After mounting the desired width of tape roll 160 onto a expandable tape hub 140 the tape roll 160 must be must be removably secured upon the expandable tape hub device 140 for effective and efficient dispensing of the tape 161. To accomplish proper securement of the tape roll 160 the cam expansion member finger grip 145 of cam expansion member 148 must be rotated approximately 90 degrees in either a counterclockwise 255 or clockwise 256 direction. By rotating the cam expansion member 348 as described the first hub half 441*a* and second hub half 441*b* of hub device 140 are caused to be transversely separated 235 approximately ¼ inch as measured along the adjacent straight walled partition found on the center portion of first hub half 441*a* and second hub half 441*b*. The transverse movement of the first hub half 441*a* and second hub half 441*b* of the expandable tape hub device 140 effectively causes the outer diameter of the expandable tape hub device 140 to transversely increase approximately ¼ inch, thus causing an outward circumferential friction gripping force to be exerted on the inner diameter 165 of the mounted tape roll 160.

Figure 3A:
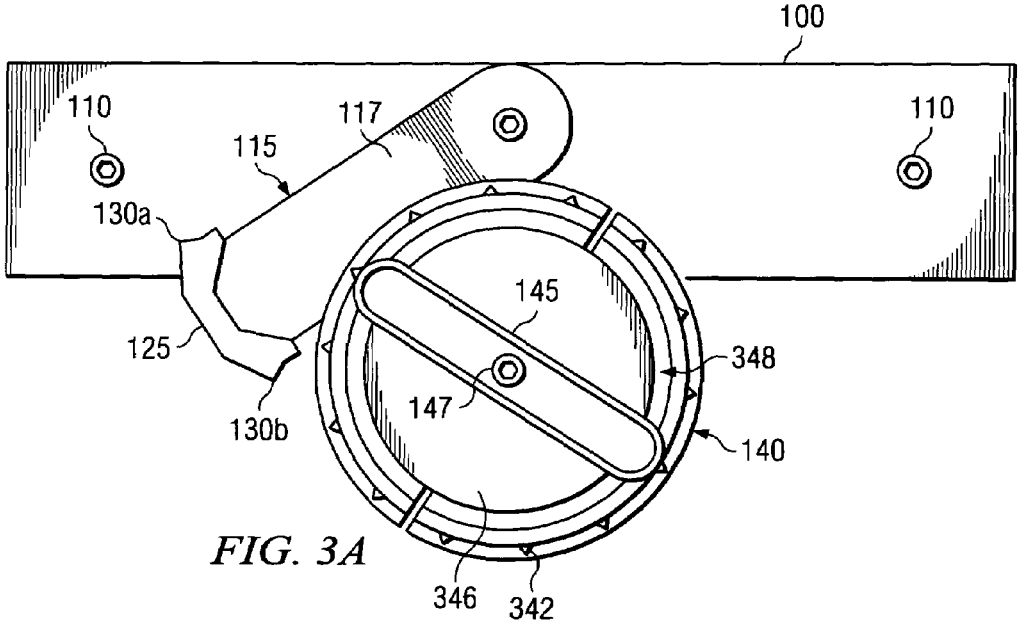
FIG. 3A is a front elevation view depicting the tape dispenser of FIG. 1 with the cutter assemblage mechanism configured for left-handed operation in accordance with the invention.
Figure 3B:
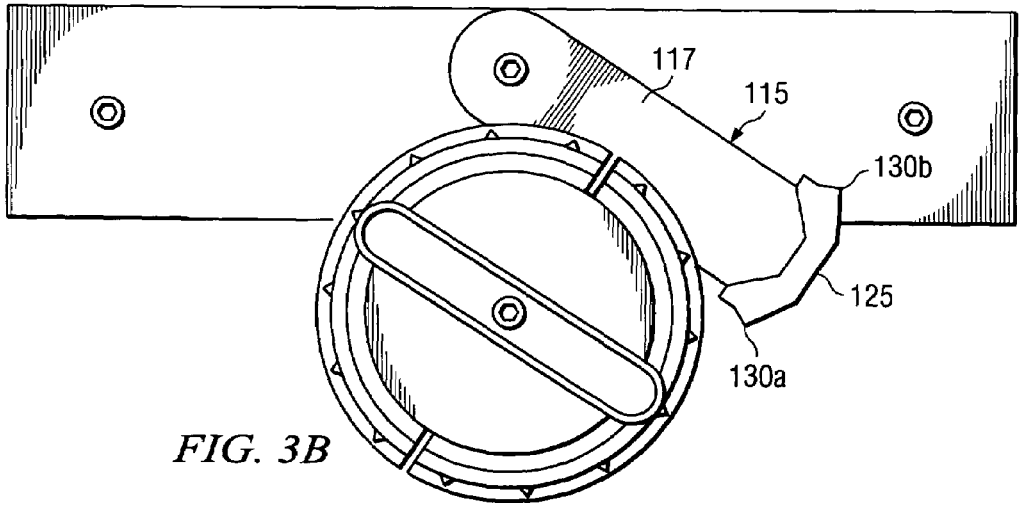
FIG. 3B is a front elevation view depicting the tape dispenser of FIG. 1 with the cutter assemblage mechanism configured for right-handed operation in accordance with the invention.

Now referring to FIGS. 3A and 3B is shown a close-up of a front elevation view of the tape dispenser 1 of the present invention. More specifically, FIG. 3A shows the tape dispenser 1 pivotally configured in a left-handed configuration wherein the cutter assemblage arm 117 and blade assembly 125 having cutting surface blades 130*a* and 130*b* is pivotally configured to rest generally to the left of the expandable tape hub 140. FIG. 3B shows the tape dispenser 1 configured in a right-handed configuration wherein the cutter assemblage arm 117 and blade assembly 125 having cutting surface blades 130*a* and 130*b* rests generally to the right of the expandable tape hub 140. FIG. 3A also depicts threaded fasteners 110 used for mounting clips 105*a*, 105*b*. Cam expansion member is attached to the frame 100 extension post 715 via fastener 147.

To dispense strips of tape 161 the tape 161 is pulled tangentially outward 256 from the mounted tape roll 160 as shown in FIG. 2 and pulled downwardly 257 over cutting surface blade 130*a* or 130*b* as determined by either left or right-hand configuration of the cutter assemblage mechanism 115. Specifically, cutting surface blade 130*a* is used for left-handed configuration and cutting surface blade 130*b* is used for right-handed configuration.

The present invention may be embodied in other specific forms without departing from its spirit or essential characteristics. The described embodiments are to be considered in all respects only as illustrative and in any way restrictive.

The scope of the invention is, therefore, indicated by the appended claims rather than by the foregoing description. All changes which come within the meaning and range of equivalency of the claims are to be embraced within their scope.

The invention claimed is:

1. A tape dispenser for dispensing tape from a tape roll comprising:

a frame;

an attachment means disposed on the frame;

an expandable tape hub device mounted to the attachment means;

a cutter assemblage mechanism mounted to the frame to facilitate cutting tape from the tape roll; and, wherein the expandable tape hub device further comprises:

a first hub half and a second hub half having an outer and inner side, wherein the inner side of the first and second hub halves include a plurality of diametrically opposed inner partition walls, wherein the first and second hub halves form an approximate outer diameter circle;

a retaining ring slidingly attached to at least two of the diametrically opposed partition walls; and, a cam expansion member slidingly engaging the inner side of the first hub half and the second hub half.

2. The tape dispenser of claim 1 wherein the inner sides of the first and second hub halves form a generally elliptical center hub aperture.

3. The tape dispenser of claim 1 wherein the retaining ring further includes a plurality of gripping tips, wherein the gripping tips attach at least two of the inner side partition walls of the first and second hub halves, thereby slidingly maintaining relative positioning of the first and second hub half.

4. The tape dispenser of claim 1 wherein the cam expansion member includes an expansion member elliptical stubshaft having a generally elliptical cross section and wherein the elliptical stubshaft is operably disposed within the elliptical center hub aperture.

5. The tape dispenser of claim 4 wherein the cam expansion member causes the first and second hub halves to transversely expand when rotated.

* * * * *